US006418599B2

(12) United States Patent
Suzuki et al.

(10) Patent No.: US 6,418,599 B2
(45) Date of Patent: Jul. 16, 2002

(54) SETTING APPARATUS FOR BLIND RIVETS OR THE LIKE

(75) Inventors: Hiromasa Suzuki; Toyoshi Kato; Yoshiaki Koike, all of Toyohashi (JP)

(73) Assignee: Emhart LLC, Newark, DE (US)

( * ) Notice: Subject to any disclaimer, the term of this patent is extended or adjusted under 35 U.S.C. 154(b) by 0 days.

(21) Appl. No.: 09/898,180

(22) Filed: Jul. 3, 2001

(30) Foreign Application Priority Data

Jul. 7, 2000 (JP) ..... 2000-206725

(51) Int. Cl.[7] ..... B21J 15/28; B21D 31/00

(52) U.S. Cl. ..... 29/243.523; 29/243.525; 72/391.4

(58) Field of Search ..... 29/243.523, 243.524, 29/243.525; 72/391.4

(56) References Cited

U.S. PATENT DOCUMENTS 3,164,283 A * 1/1965 Olson ..... 29/243.523
3,367,166 A * 2/1968 Newton et al. ..... 29/243.523
3,898,833 A 8/1975 Richardson
4,454,746 A 6/1984 Schwab
5,946,784 A * 9/1999 Komsta et al. ..... 29/243.523

FOREIGN PATENT DOCUMENTS

JP 11138230 5/1999

* cited by examiner

*Primary Examiner*—David Jones
(74) *Attorney, Agent, or Firm*—Edward D. Murphy

(57) ABSTRACT

A setting apparatus 30 in which a mandrel of a blind rivet is inserted into a hole 47 of a nose at the front end of the setting apparatus, and wherein a rivet body of the rivet is projected from the nose into a mounting hole of a workpiece. The mandrel is pulled rearward of the nose with a force capable of breaking the mandrel and expanding a shank of the rivet body so that the rivet is set in the workpiece by the expanded shank and a flange of the rivet body, followed by discharging of the broken mandrel from the setting apparatus. The force for pulling the mandrel is obtained from hydraulic pressure of a hydraulic cylinder 34. The hydraulic pressure is produced by a piston 41 which moves in a pneumatic cylinder 39 adjacent to the hydraulic cylinder. The nose 31 is axially aligned with an apparatus body 33 including the hydraulic cylinder and the pneumatic cylinder 39 along the longitudinal direction of the setting apparatus 30 from the front end to the rear end thereof. A discharge path for the broken mandrel is formed 5 by a hollow tube extending from the mandrel inserting hole 47 of the nose through (tubes 49 and 50 of) the apparatus body and (a tube 51 of) the hydraulic cylinder to the rear end 53 of the setting apparatus.

2 Claims, 6 Drawing Sheets

SETTING APPARATUS FOR BLIND RIVETS OR THE LIKE

BACKGROUND OF THE INVENTION

The present invention relates to a setting apparatus for fasteners of the type in which during setting a blind rivet, lock bolt or the like a mandrel thereof is broken. More specifically, the present invention relates to a setting apparatus for blind rivets which includes a mechanism for discharging the broken mandrel from a nose of the setting apparatus through the inside thereof and is suitable for inserting and setting a blind rivet into a workpiece from the position above the workpiece.

A fastener such as a blind rivet or a lock bolt has been well known which comprises a hollow rivet body and a mandrel inserted into this rivet body. Generally, a hydraulic actuated setting apparatus is used in a setting operation for setting the fastener in a workpiece. The setting apparatus is provided with a jaw at a nose defined by the front end of the apparatus to hold the mandrel of the blind rivet. When the mandrel of the blind rivet is inserted into the nose to hold the mandrel with the jaw, while a rivet body of the blind rivet will be projecting from the nose into a mounting hole of the workpiece. When the setting apparatus is triggered, a piston of a pneumatic cylinder is actuated and then this piston is slidably moved in a hydraulic cylinder to produce a high hydraulic pressure. Then, by this hydraulic pressure, the jaw is driven within the setting apparatus in a pull-in direction for pulling the mandrel strongly enough to break or fracture the mandrel at a desired breakable position and to expand a shank of the rivet body so that the rivet body is set in the workpiece by the expanded shank and a flange of the rivet body. The broken mandrel is released from the jaw, and then transferred in the setting apparatus from the front end to the rear end thereof,whereafter the broken mandrel is discharging from the rear end of the setting apparatus or collected by a broken mandrel collecting vessel provided at the rear end of the setting apparatus.

One type of well known conventional blind rivet setting apparatus is disclosed in U.S. Pat. No. 3,898,833. In this type of setting apparatus, a handle with a trigger extends to intersect with an apparatus body extending rearward from a nose of the setting apparatus. This may provide a convenient configuration for being gripped by an operator and may serve various uses. However, this setting apparatus is not suited to the operation for inserting and setting a blind rivet into and in a workpiece from the position above the workpiece in the position higher than the waist position of an operator. This is because when the front end of the setting apparatus is placed on the workpiece located in a position higher than the waist position of the operator from the position above the workpiece, the operator is forced to grip the handle in an unnatural manner, resulting in unpractical operation performance. A setting apparatus suitable for inserting and setting a blind rivet into and in a workpiece from the position above the workpiece.

One example of such a prior art apparatus is shown in FIGS. 1 and 2. In FIG. 1, the setting apparatus I comprises a nose 2, an apparatus body 3 extending rearward (upward in the figure) from the nose 2, and a pneumatic cylinder 5 extending further rearward from the apparatus body 3. A hydraulic cylinder is provided inside of the apparatus body 3 at a position adjacent to the pneumatic cylinder 5. The setting apparatus 1 is formed to extend longitudinally from the nose 2 to the pneumatic cylinder 5 in totality. The apparatus body 3 of the setting apparatus 1 is provided with a handle 6 having a trigger lever 7 attached thereto. An operator may carry out a setting operation of a fastener (not shown) such as a blind rivet from the position above a workpiece by gripping the apparatus body 3 having the handle 6 and directing the nose 2 of the setting apparatus 1 downward. A hanging member 9 is attached to the apparatus body 3 of the setting apparatus 1. As shown in FIG. 2, the hanging member 9 is supported by a power-assist arm 13 to which a cross piece 11 of a supporting post 10 is mounted. Thus, the power-assist arm 13 bears a weight corresponding to that of the setting apparatus 1 to allow load applied to hands of the operator to be reduced and thereby to facilitate the setting operation. A compressed air supply pipe 14 is coupled to the setting apparatus 1. By gripping the trigger lever 7 of the handle 6, compressed air may be introduced into the pneumatic cylinder 5, the operation of which will compress oil in an adjacent hydraulic cylinder to carry out the setting operation, as described and shown hereinafter.

In the vertical type setting apparatus 1 extending longitudinally as shown in FIGS. 1 and 2, a pneumatic cylinder 5 is provided above the rear end (i.e. upper end) of the apparatus body 3, and has no handle intersecting with the apparatus body. Thus, the apparatus may be reduced in size and weight, and is suited to the operation for inserting and setting a blind rivet into and in a workpiece from the position above the workpiece, which position may be higher than the waist position of an operator. However, since the pneumatic cylinder having a large diameter is provided at the rear end or the upper end of the apparatus, the mandrel broken by the pull-action of the jaw is required to get around the pneumatic cylinder 5 in order to be discharged at the rear end of the setting apparatus 1. This is possible by providing a curved broken mandrel discharge path. The broken mandrel discharge path is defined by the reference number 15 in FIGS. 1 and 2. FIG. 3 shows a state in which this broken mandrel discharge path 15 is curved in an area where the path comes out of the apparatus body 3. In FIG. 3, the broken mandrel discharge path 15 is curved in the area 16. If a precedent broken mandrel is jammed in this curved area 16*a* and a subsequently broken mandrel is provided, the path can be undesirably clogged by the conjuncture between the broken mandrels 18A and 18B shown by dotted lines in FIG. 3.

Another type of prior art blind rivet setting apparatus, different from the setting apparatus 1 shown in FIGS. 1 to 3, is shown in FIG. 4, where there is another setting apparatus 1A in which a nose 2 and apparatus body 3, and a pneumatic cylinder 17 are provided in the longitudinal direction of the setting apparatus with offsetting their axes respectively. In this setting apparatus 18, when a compressed air is supplied to an upper end of a piston 19 of a pneumatic cylinder 17 to move a piston rod 21 into an oil sump 22, the resulting compressed oil is supplied to a hydraulic cylinder 23 provided inside of the apparatus body 3. Then, a hydraulic piston 25 is moved upward to pull up a jaw 26 disposed in the front end of the nose 2. This pull-up force is strong enough to break the mandrel of the fastener held by the jaw 26. In this setting apparatus 18, the broken mandrel can be discharged from an exit 27 through a hollow tube formed at the center of the nose 2 which receives therein a hollow tube of the hydraulic piston 25 shiftably mounted in the apparatus body 3, and thus this discharge path is straight and not curved. This is because the axis of the pneumatic cylinder 17 is offset from the nose 2 and apparatus body 3 and thereby the path is not required to go around the pneumatic cylinder 17. However, this pneumatic cylinder 17 having the axis offset from the nose 2 and the apparatus body 3 leads to a large setting apparatus and heavier setting apparatus as a whole. Thus, this setting apparatus may not be well suited to the operation of inserting and setting a blind rivet into and in a workpiece from the position above the workpiece or in the position higher than the waist position of an operator.

SUMMARY OF THE INVENTION

Thus, in a setting apparatus for blind rivets of the type in which setting is achieved by breaking a mandrel of a blind rivet, it is an object of the present invention to provide a compact and lightweight setting apparatus capable of discharging the resulting broken mandrel without any jamming.

In order to achieve the above object, the present invention provides a setting apparatus for blind rivets, constructed such that a mandrel of a fastener is inserted into a hole of a nose at the front end of the setting apparatus, and while a rivet body of the fastener is projected from the nose into a mounting hole of a workpiece, the mandrel is pulled rearward of the nose with a force capable of breaking the mandrel to expand a shank of the rivet body so that the fastener is set onto the workpiece by the expanded shank and a flange of the rivet body, followed by discharging the broken mandrel out of the setting apparatus, wherein the force for pulling the mandrel is obtained from hydraulic pressure of a hydraulic cylinder, the hydraulic pressure being produced by a piston which moves in a pneumatic cylinder adjacent to the hydraulic cylinder. The setting apparatus has the nose thereof aligned with the apparatus body which includes the hydraulic cylinder and the pneumatic cylinder aligned in the longitudinal direction from the front end to the rear end thereof, and a discharge path for the broken mandrel is formed by a hollow tube extending from the mandrel insertion hole at the nose through the apparatus body and the hydraulic cylinder to the rear end of the setting apparatus.

In the aforementioned setting apparatus, the construction in which the nose is arranged with the apparatus body including the hydraulic cylinder and the pneumatic cylinder along the longitudinal direction of the setting apparatus allows the setting apparatus to be reduced in size and weight. Further, since the broken mandrel discharge path extends from the nose through the apparatus body and the pneumatic cylinder to the rear end of the setting apparatus, the discharge path need not be curved. Thus, the broken mandrel may smoothly pass through the discharge path and may be discharged from the setting apparatus without any jamming in the path. Furthermore, arranging the exit of the discharge path at the rear end of the setting apparatus allows an air hose for supplying a compressed air and a hose for discharging the mandrel to be concentrated at the rear end or upper end of the setting apparatus. This provides easy arrangement of such hoses.

In the aforementioned setting apparatus, the broken mandrel discharge tube preferably extends linearly in the longitudinal direction of the setting apparatus. A mandrel collecting device may be attached to a mandrel discharge port of the broken mandrel discharge tube at the rear end of the setting apparatus.

As described above, according to the present invention, arranging the nose, the apparatus body including the hydraulic cylinder and the pneumatic cylinder along the longitudinal direction of the setting apparatus allows the setting apparatus to be reduced in size and weight. Further, since the broken mandrel discharge path extends from the nose through the apparatus body and the pneumatic cylinder to the rear end of the setting apparatus, the discharge path is not curved. Thus, the broken mandrel may smoothly pass through the discharge path and may be discharged from the setting apparatus without any jamming in the path. Furthermore, arranging the exit of the discharge path at the rear end of the setting apparatus allows the air hose for supplying the compressed air and the hose for discharging the mandrel to be concentrated at the rear end or upper end of the setting apparatus. This provides easy arrangement of such hoses. The broken mandrel collecting device may be coupled to the broken mandrel discharge port at the rear end of the setting apparatus. This allows the necessity for coupling the broken mandrel discharge hose to be eliminated, and thereby provide easy arrangement of such hoses, and enhanced operation performance. In addition, the necessity for piping such hoses is eliminated.

BRIEF DESCRIPTION OF THE ACCOMPANYING DRAWINGS

DETAILED DESCRIPTION OF THE INVENTION

Figure 1:
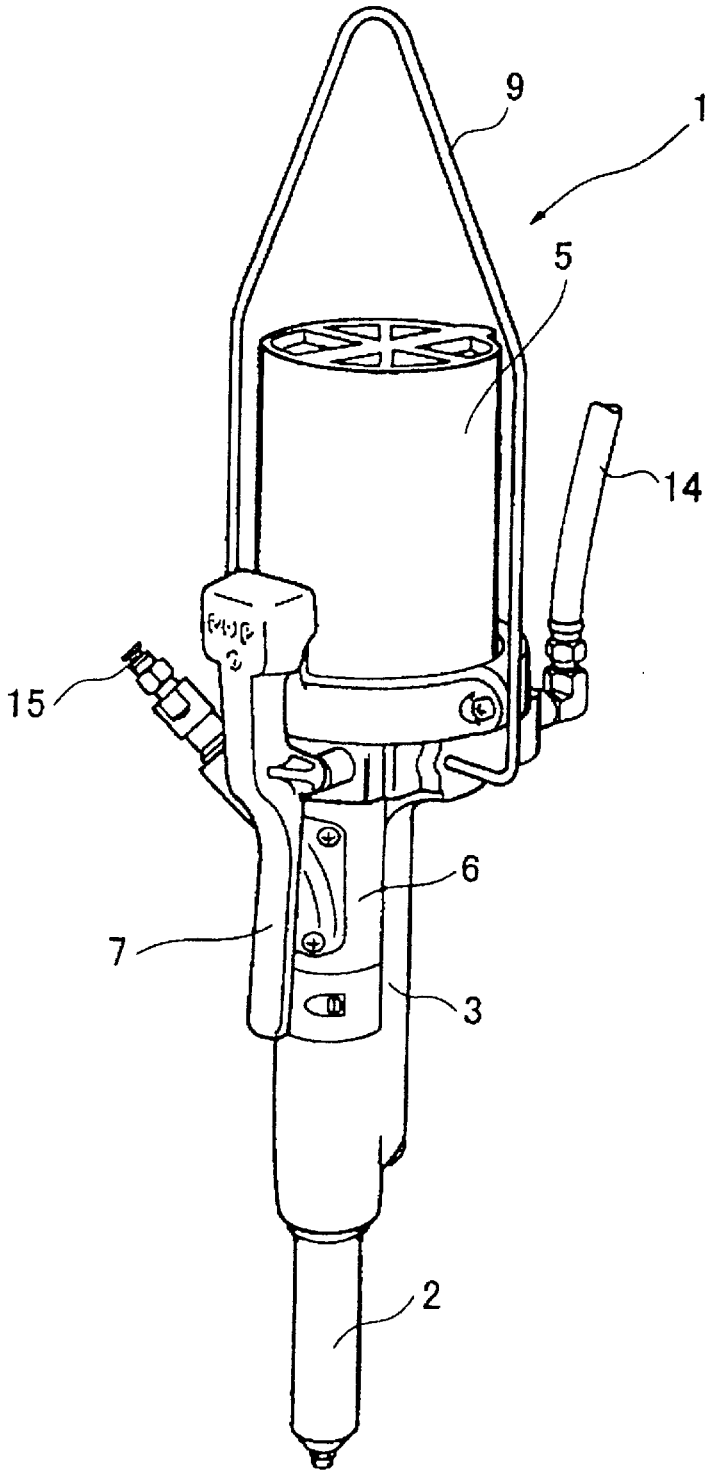
FIG. 1 is a front view of a conventional setting apparatus of the type capable of reducing in size and weight.

With reference to the drawings, embodiments of the present invention will now be described. FIG. 5 shows a setting apparatus 30 for fasteners, such as blind rivets or the like, according to a first embodiment of the present invention. In FIG. 5, a nose 31 and an apparatus body 33 of the setting apparatus 30 is similar to the nose 2 and the apparatus body 3 of the setting apparatus 1A in FIG. 4. Thus, in order to make the following explanation clear, only the front end of the nose 31 and the rear half portion (upper portion of the figure) including a hydraulic cylinder 34 of the apparatus body 33 will be described and illustrated, and most of the portion of the nose 31, while the front half portion of the apparatus body 33 has been omitted. Since the setting operation of the setting apparatus 30 is also similar to that of the setting apparatus 1A in FIG. 4, it is omitted. As needed, the description of the setting apparatus 1A in FIG. 4 may be referred to. In the setting apparatus 30, jaws 35, 35 are provided at the nose 31 to hold a mandrel shank (not shown) inserted from a hole at the front end of the nose 31. A handle 37 is provided at the apparatus body 33, and a trigger lever 38 is attached to the handle 37. In the setting apparatus 30, the axis of the nose 31 is aligned with the axis of the apparatus body 33 (and the hydraulic cylinder 34).

In the present invention, a pneumatic cylinder 39 is arranged the rearward of the apparatus body 33 including the nose 31 and the hydraulic cylinder 34 in the longitudinal direction of the setting apparatus 30. A piston rod 42 of a piston 41 provided in the pneumatic cylinder 39 reciprocates in an oil sump or oil reservoir 43 in fluid communication with the front end of the hydraulic cylinder 34, and the oil sump 43 is arranged in parallel with the apparatus body 33. While the axis of the pneumatic cylinder 39 cannot be matched with the axis of the nose 31 and the apparatus body 33, the present invention can provide a short distance between these axes by arranging the pneumatic cylinder 39 along the longitudinal direction of the setting apparatus 30. This allows the setting apparatus 30 to be formed in reduced size and weight. Compressed air is supplied to the pneumatic cylinder 39 from a compressed air supply section 45 through a valve 46. The valve 46 is controlled by the trigger lever 38. The valve 46 is opened by squeezing the trigger lever, and thereby the compressed air is introduced into the pneumatic cylinder 39 to move the piston 41 downward in FIG. 5. Then, the piston rod 42 is moved into the oil sump 43 to supply the compressed oil to the hydraulic cylinder 33, and the jaw 35 is pulled up strongly to break the mandrel shank.

Figure 2:
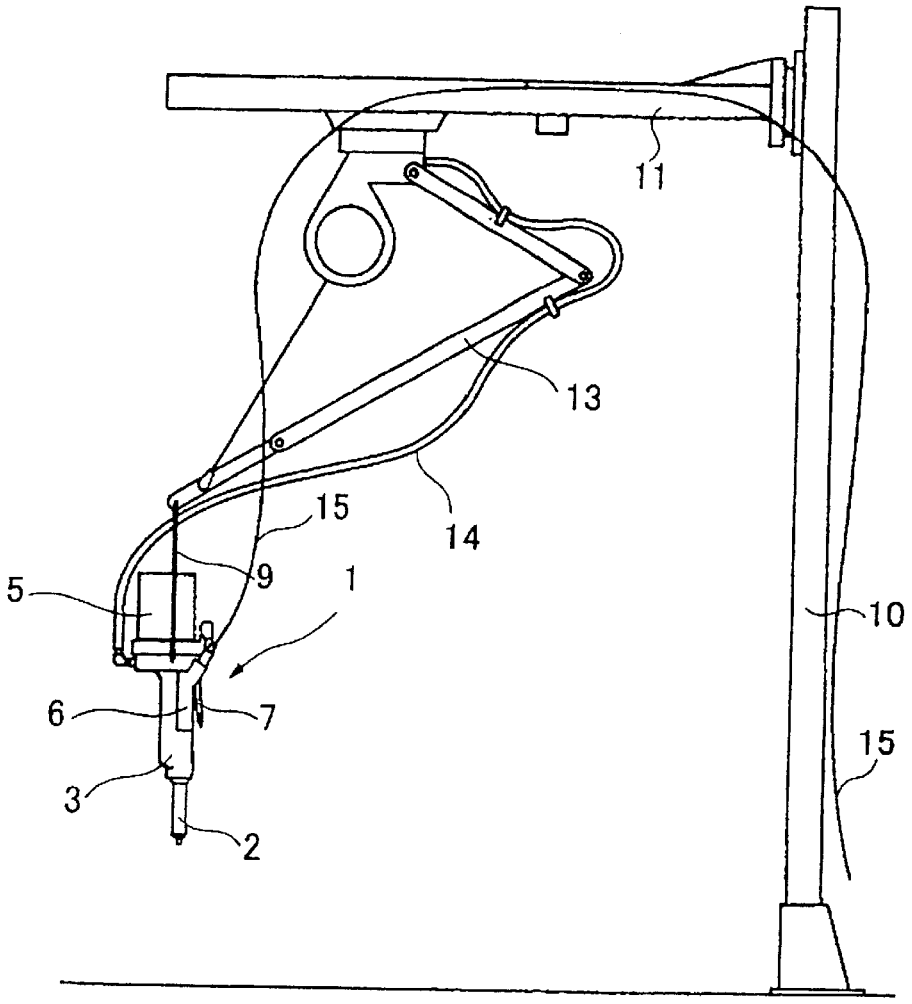
FIG. 2 is a view showing a construction that the setting apparatus of FIG. 1 is hung to use.
Figure 3:
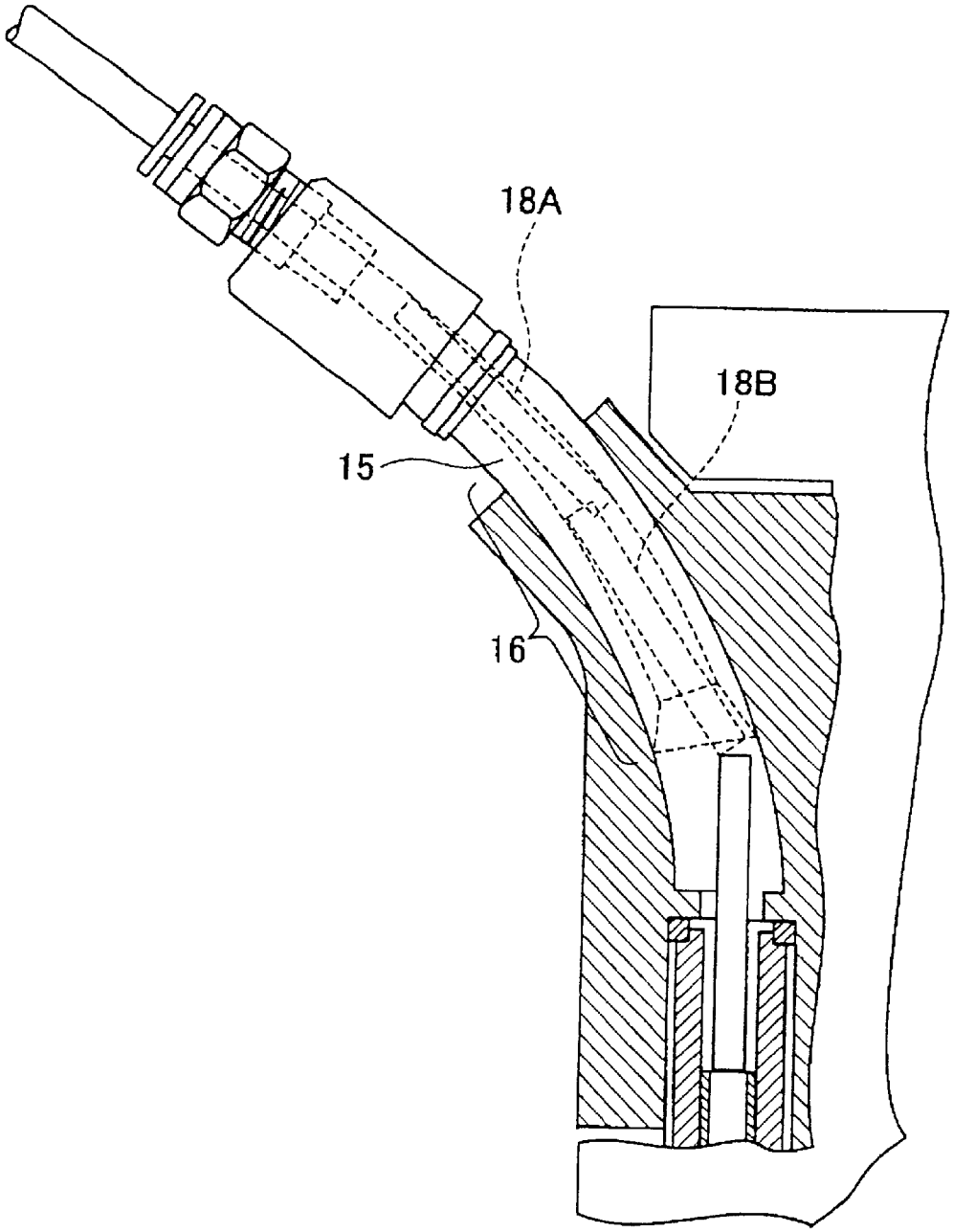
FIG. 3 is a partial cutaway view showing details of a broken mandrel discharge portion of the setting apparatus of FIG. 1.
Figure 4:
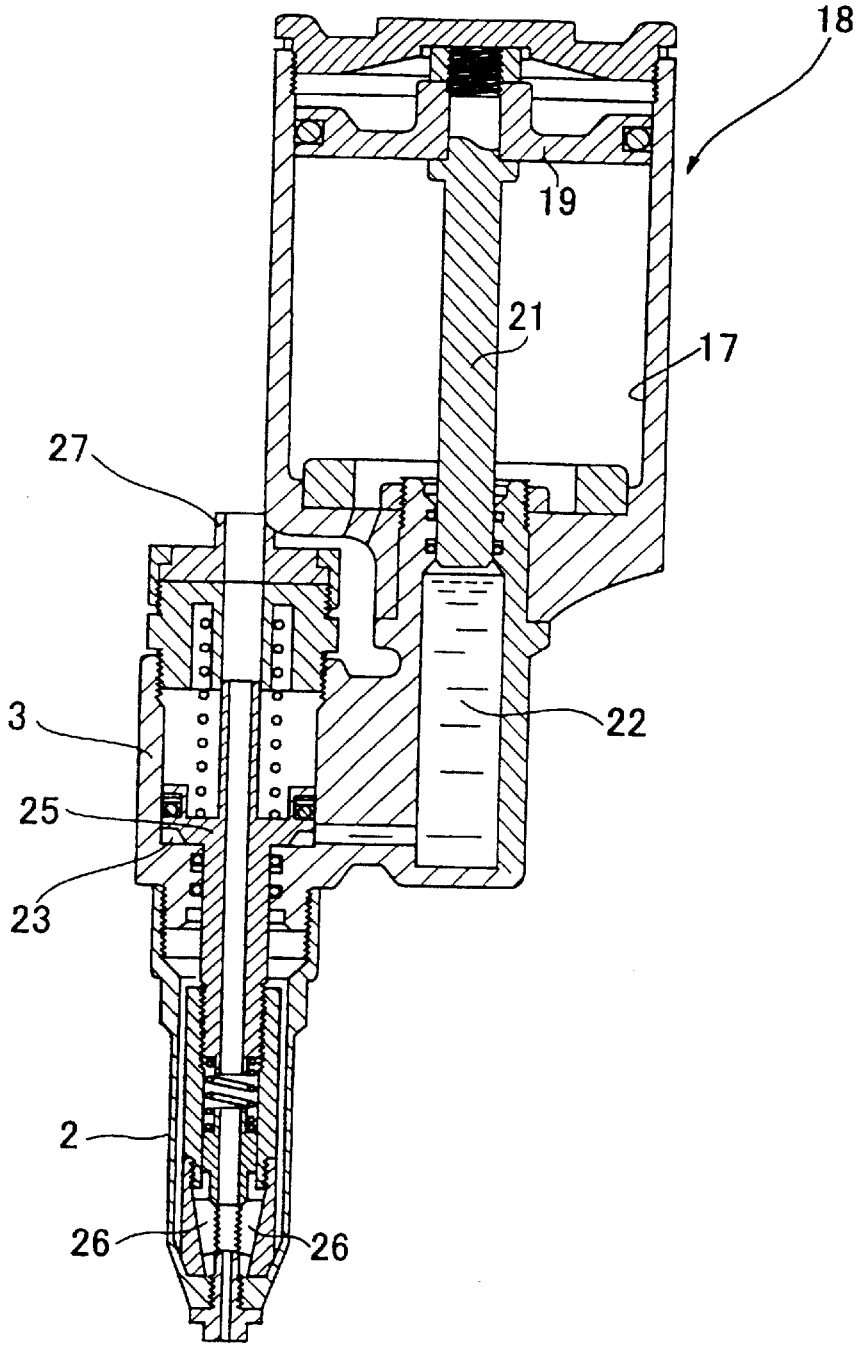
FIG. 4 is a vertical sectional view of another conventional setting apparatus.
Figure 5:
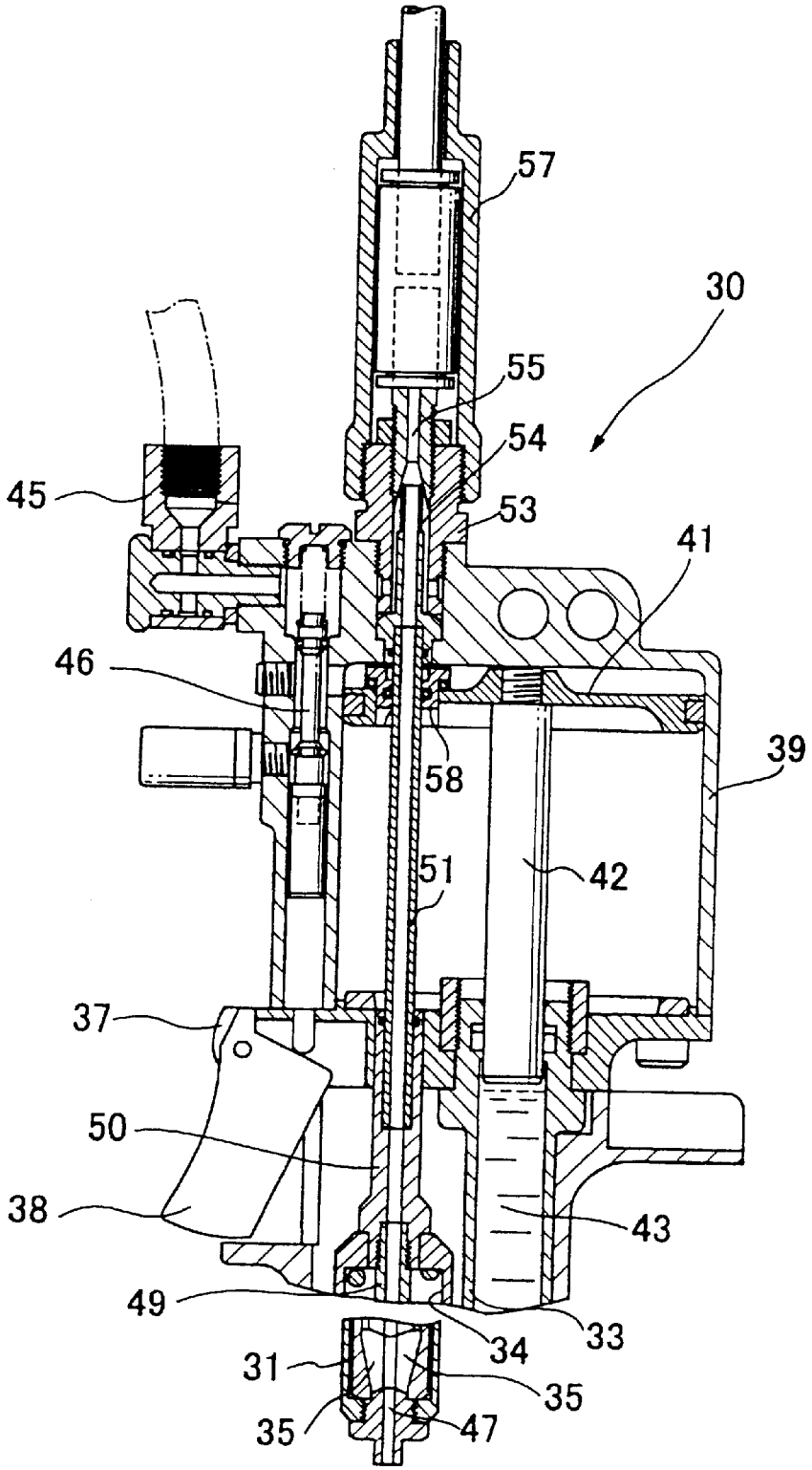
FIG. 5 is a vertical sectional view of a setting apparatus for blind rivets or the like according to a first embodiment of the present invention, partly cut away, wherein most of a nose and a half of a front end of an apparatus body are omitted.

In the present invention, the discharge path of the mandrel broken by the jaw 35 is formed by a mandrel hole 47 on the axis of the nose 31, a tube 49 and a tube 50 at the rearward thereof which are provided on the axis of the hydraulic cylinder 34 of the apparatus body 33, a tube 51 which extends through the pneumatic cylinder 39 to the rear end of the setting apparatus 30, and a tube 55 provided at a rear end 53 of the setting apparatus 30 and including a vacuum suction mechanism 54 for the broken mandrel (As to the details of the action of this vacuum suction mechanism, refer to FIG. 4). A broken mandrel discharge hose 57 is coupled to the discharge port of the tube 55 to discharge the broken mandrel outside in the same manner as that in FIG. 2.

As shown in FIG. 5, the broken mandrel discharge path composed of the mandrel hole 47, the tubes 49, 50, 51 and 55 extends linearly on the same axis extending in the longitudinal direction of the setting apparatus 30, and without any curve. Thus, since the broken mandrel may smoothly pass through the discharge path and may be discharged from the setting apparatus, the broken mandrel is never jammed in the discharge path. Further, since the exit of the discharge path is arranged at the rear end of the setting apparatus 30, the mandrel discharge hose 57 may be attached at the rear end of the setting apparatus adjacent to the compressed air supply section 45. Thus, the air hose coupled to the compressed air supply section 45 and the mandrel discharge hose 57 can be concentrated at the rear end or upper end of the setting apparatus to provide easy arrangement of such hoses.

The hollow tube 51 penetrating through the pneumatic cylinder 39 may be made of any suitable material capable of withstanding the pneumatic pressure in the pneumatic cylinder 39. Thus, the material is not limited to metal, and may be plastic. Further, the piston 41 reciprocating in the pneumatic cylinder is provided with a seal section 58 at a portion where the tube 51 penetrates through the piston 41 in order to prevent the leak of the compressed air.

Figure 6:
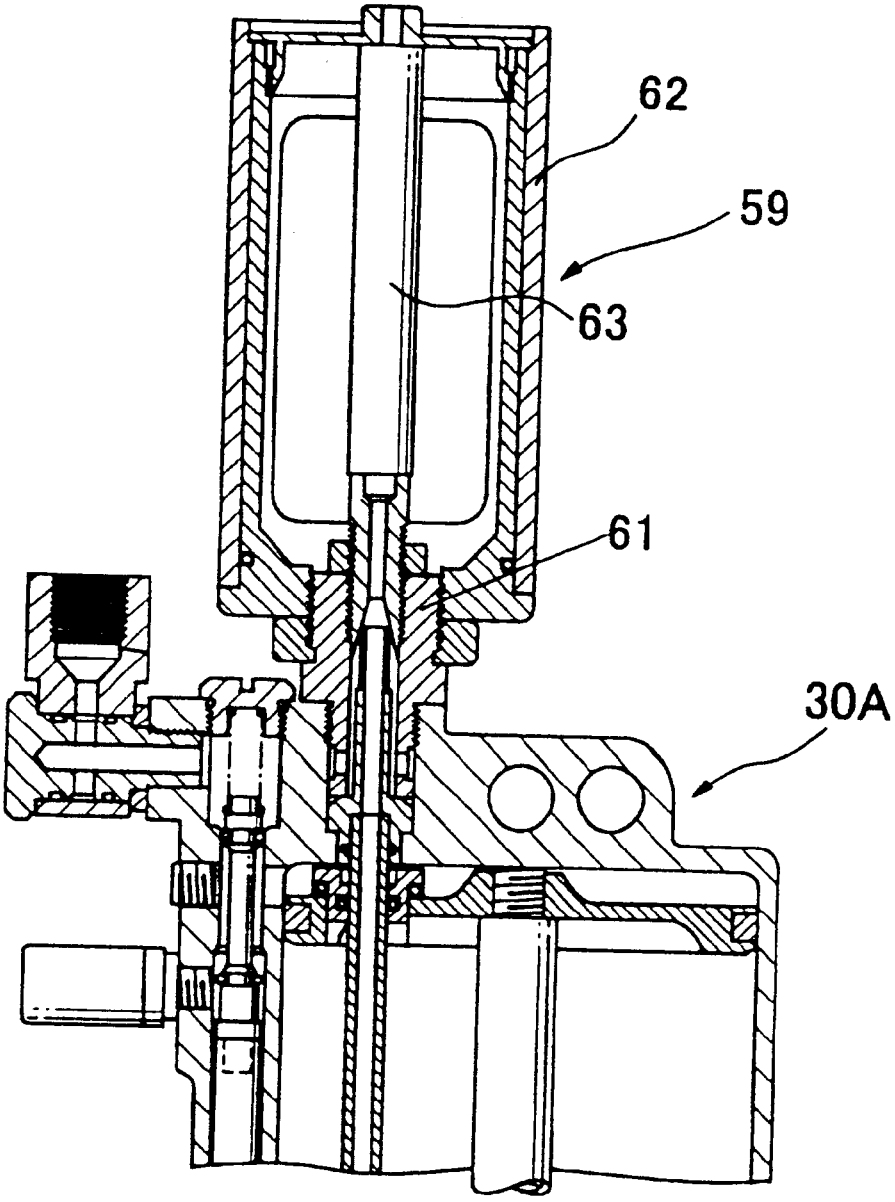
FIG. 6 is a vertical sectional view showing the rearward of a setting apparatus according to a second embodiment of the present invention.

FIG. 6 shows a setting apparatus 30A according to a second embodiment of the present invention. In this setting apparatus 30A, instead of the mandrel discharge hose, a broken mandrel collecting device 59 is attached at the rear end of the setting apparatus 30A to collect the broken mandrel. The broken mandrel collecting device 59 has a vessel 62 surrounding an exit 61 of the broken mandrel discharge path of the setting apparatus 30A and extending to extend the path so as to receive the broken mandrel discharged from the extended path. To prevent the intertwisting of the broken mandrel, the vessel 62 is provided with a broken mandrel anti-intertwisting member 63 in the form of an elongated rod extending within the vessel 62. This anti-intertwisting member 63 can prevent the broken mandrel from intertwisting in the vessel. As described above, providing the broken mandrel collecting device 59 may eliminate the necessity for coupling the broken mandrel discharge hose. This also provides easy arrangement of such hoses and enhanced operation performance. In addition, the necessity for piping such hoses is eliminated.

In general, the above identified embodiments are not to be construed as limiting the breadth of the present invention. It is understood that the present invention may be modified or have other alternative constructions that are apparent from and within the scope of the present invention as defined in the appended claims.

What is claimed is:

1. An axially inline setting apparatus for setting a blind rivet in a mounting hole of a workpiece, the blind rivet having a rivet body mounted on a mandrel with a breakable portion, the setting apparatus comprising:

a. a nose formed on the front end of the setting apparatus and having a hole to receive and clamp the mandrel of the blind rivet therein;

b. a force exerting means communicating with the nose;

c. the force exerting means having pneumatic means and hydraulic means to coact with each other to exert force on the mandrel through the nose;

d. the pneumatic means disposed in superposition to the nose; and e. a collection conduit extending internally of the pneumatic means to be connected to the nose to receive the breakable portion of the mandrel therein to be discharged therethrough.

2. The combination claimed in claim 1 wherein:

a. a collection device connected to the setting apparatus at the end thereof opposite the nose thereof; and b. the collection conduit connected to terminate in the collection device whereby the breakable portions of the mandrel will be deposited in the collection device.

* * * * *